US008622773B2

(12) United States Patent
Curnis et al.

(10) Patent No.: US 8,622,773 B2
(45) Date of Patent: Jan. 7, 2014

(54) CONNECTING FLEXIBLE CONDUCTORS USING COLD PLASTIC DEFORMATION

(75) Inventors: Maurizio Curnis, Carvico (IT); Matteo Maura, Ceccano (IT)

(73) Assignee: ABB S.p.A., Milan (IT)

( * ) Notice: Subject to any disclaimer, the term of this patent is extended or adjusted under 35 U.S.C. 154(b) by 21 days.

(21) Appl. No.: 13/055,063

(22) PCT Filed: Jun. 29, 2009

(86) PCT No.: PCT/EP2009/058134

§ 371 (c)(1),
(2), (4) Date: Jan. 20, 2011

(87) PCT Pub. No.: WO2010/009957

PCT Pub. Date: Jan. 28, 2010

(65) Prior Publication Data

US 2011/0120845 A1 May 26, 2011

(30) Foreign Application Priority Data

Jul. 23, 2008 (IT) ..... MI2008A1336

(51) Int. Cl.
*H01R 4/02* (2006.01)

(52) U.S. Cl.
USPC ..... 439/880; 439/708

(58) Field of Classification Search
USPC ..... 439/708, 709, 877, 880; 174/84 C, 88 R
See application file for complete search history.

(56) References Cited

U.S. PATENT DOCUMENTS

| | | | | |
|---|---|---|---|---|
| 2,909,756 | A * | 10/1959 | Sitz | 439/721 |
| 3,698,083 | A * | 10/1972 | Schreck | 29/883 |
| 6,751,849 | B1 | 6/2004 | Helmke et al. | |

FOREIGN PATENT DOCUMENTS

| | | | |
|---|---|---|---|
| CN | 1208986 | A | 2/1999 |
| CN | 101202183 | A | 6/2008 |
| DE | 29614720 | U1 | 12/1997 |
| DE | 19902836 | A1 | 7/2000 |
| DE | 102004058764 | A1 | 6/2006 |
| EP | 1914768 | A1 | 4/2008 |
| FR | 1279798 | A | 12/1961 |
| RU | 2096148 | C1 | 11/1997 |
| RU | 33833 | U1 | 11/2003 |
| SU | 1425010 | A1 | 9/1988 |
| SU | 1700659 | A1 | 12/1991 |

OTHER PUBLICATIONS

Chinese Office Action dated Mar. 11, 2013.

* cited by examiner

*Primary Examiner* — Khiem Nguyen
(74) *Attorney, Agent, or Firm* — Novak Druce Connolly Bove + Quigg LLP

(57) ABSTRACT

Electrical component for low-voltage switching devices having an electrode comprised of a substantially rigid body with one or more slots and at least one flexible conductor with an end portion inserted into and joined to an associated slot by means of cold plastic deformation.

18 Claims, 7 Drawing Sheets

CONNECTING FLEXIBLE CONDUCTORS USING COLD PLASTIC DEFORMATION

CROSS REFERENCE TO RELATED APPLICATIONS

This application is a National Phase filing under 35 U.S.C. §371 of PCT/EP2009/058134 filed on Jun. 29, 2009; and this application claims priority to Application No. MI2008A001336 filed in Italy on Jul. 23, 2008 under 35 U.S.C. §119; the entire contents of all are hereby incorporated by reference.

The present invention relates to an electrical component for low-voltage switching devices, to a method for manufacturing this electrical component, and to an electrical switching device, particularly a switch, or an isolating switch, or a contactor, or similar devices, containing this electrical component.

As is known, switching devices used in low-voltage electrical circuits (i.e. applications with operating voltages of up to 1000V AC/1500V DC), typically switches, isolating switches and contactors, generally referred to as "switching devices" and hereafter for brevity referred to as switches, are devices designed to enable the correct operation of specific parts of electrical systems and the loads operationally associated with them.

These switches comprise a casing containing at least one fixed contact and a respective moving contact, which are each connected to a corresponding terminal for input/output connection with the associated electrical circuit.

Typically, the moving contacts of the switches are each connected to the respective terminal by means of a flexible conductor, constituted for example of flexible braids or strips.

Methods used by current technology to manufacture the junctions between the flexible conductor and the moving contact and the terminal are usually based on arc brazing or welding processes.

These processes generate high temperatures for relatively long periods in a significant area surrounding the welding zone. This causes annealing phenomena that can affect both the terminal and above all the flexible conductor, with a consequent decline in the mechanical properties of both components.

Also from the point of view of electrical conductivity, the use of braze welding presents problems due to the presence of brazing substances used for the process but electrically harmful, and to the impossibility of achieving sufficient compactness in the junction zone. In the best cases, the filling factor, i.e. the full/empty ratio in the junction zone, reaches only 85%. The presence of brazing substances and/or discontinuities in the junction zone is manifested in the form of localised increases in electrical resistance, which in the presence of a current are known to lead to unwanted increases in temperature.

On the other hand, it is difficult to find an industrially feasible alternative to these methods, since they involve joining elements that are morphologically very different.

It must be remembered in particular that the flexible conductors may be subject to strong electro-dynamic phenomena, the energy from which is discharged in the form of tearing along the junction or welding areas of the conductor, which must therefore have a considerable degree of mechanical stability. In addition, the dimensions of the flexible conductor and the connecting terminal may also be relatively extensive, and consequently the welding system must have adequate power.

Alternative solutions include the use of laser welding techniques, which enable the elimination of brazing substances and a reduction in annealing phenomena, but do not significantly improve the filling factor.

Another known solution is so-called ultrasonic welding, which does not suffer from the annealing problems mentioned above, but is not practical to use given its known power limits.

Therefore, the main object of the present invention is to provide a solution for the connection of flexible conductors to rigid conducting elements such as terminals, which is a valid alternative to known solutions and will make it possible to achieve overall better performance and improved characteristics.

This object is achieved by means of an electrical component for low-voltage switching devices, characterised in that it comprises an electrode comprised of a substantially rigid body with one or more slots and at least one flexible conductor with an end portion inserted into and joined to an associated slot by means of cold plastic deformation.

Another aspect of the present invention relates to a method for manufacturing an electrical component for low-voltage switching devices, characterised in that it includes the following steps:

- preparing an electrode comprised of a substantially rigid body on which there are one or more slots;
- preparing at least one flexible conductor with an end portion that can be inserted into one of said slots;
- inserting said end portion into an associated slot;
- joining said end portion to the associated slot by means of cold plastic deformation.

Other features and advantages of the electrical component and relative method of manufacturing according to the invention will become more apparent from the following detailed, though not exclusive, description of preferred embodiments, illustrated by way of non-limitative example in the accompanying drawings, in which.

Figure 1:
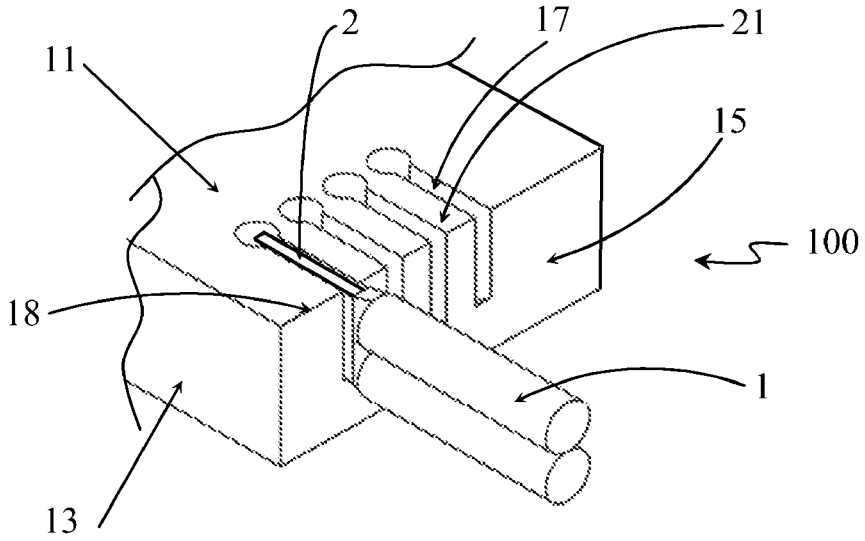
FIG. 1 is a perspective view partially illustrating a first embodiment of the electrical component according to the invention.

With reference to the figures, the electrical component according to the invention, indicated as a whole by the reference number 100, comprises an electrode 10 with a shaped body made from a substantially rigid block of electrically conductive material, typically copper, which—where necessary—may be fully or partially covered by a layer of silver-plating.

In the embodiments illustrated, the electrode 10—which in practice is a connecting terminal—has a body with an upper face 11 and a lower face 12, two side faces 13 and 14 transversal to the upper face 11 and lower face 12, and a front face 15 and a rear face 16 that are also transversal to the upper face 11 and lower face 12, and to said side faces 13 and 14.

Figure 11:
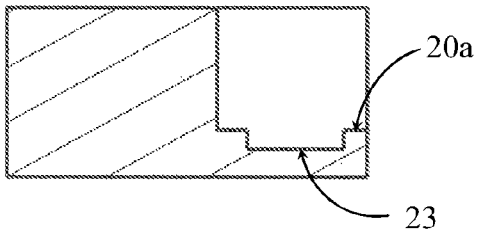
FIG. 11 is a cross-section side view of the electrode shown in FIG. 10.
Figure 12:
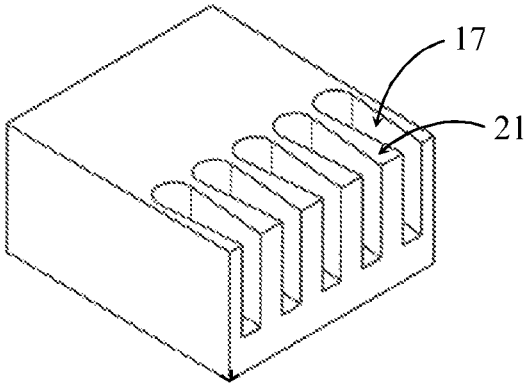
FIG. 12 is a perspective view partially illustrating a sixth form of manufacturing of an electrode used in the electrical component according to the invention.
Figure 13:
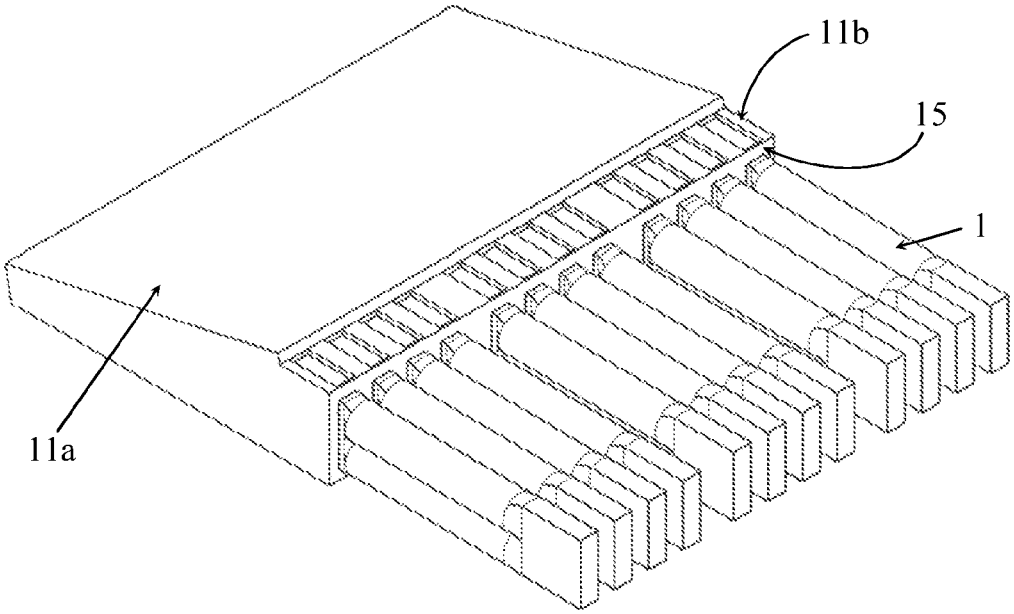
FIG. 13 is a perspective view partially illustrating a third form of manufacturing of the electrical component according to the invention.

In particular, in the embodiments illustrated in FIGS. 1-12, the body of the electrode 10 is preferably substantially parallelepiped in shape with the various faces perpendicular to each other; in the embodiment illustrated in FIG. 13, the upper face 11 has a first oblique section 11*a* that joins to a second section 11*b* substantially perpendicular to the front face 15. In any case, it is clear how the electrode 10 can assume various configurations provided they are compatible with its use.

Advantageously, the body of the electrode 10 has one or more seats or slots 17.

In the embodiments illustrated in FIGS. 1-12, the seats or slots 17 are preferably positioned at the common edge 18 between the upper face 11 and the front face 15. In this case, the slots 17 are open both on the upper face 11 and on the front face 15 and extend for a section into the body 10 in a direction substantially parallel to the side faces 13 and 14. In the embodiment illustrated in FIG. 13, the slots 17 are made and opened only on the front face 15. Alternatively, the slots 17 could be made and opened only on the upper face 11.

The electrical component 100 also comprises at least one flexible conductor 1, made for example of one or more braids of copper, or alternatively of flexible blades also made of copper or another equivalent, electrically-conductive material. The flexible conductor 1 has a specifically shaped end portion 2 that is inserted into a corresponding slot 17 and is joined to it by means of cold plastic deformation.

Figure 18:
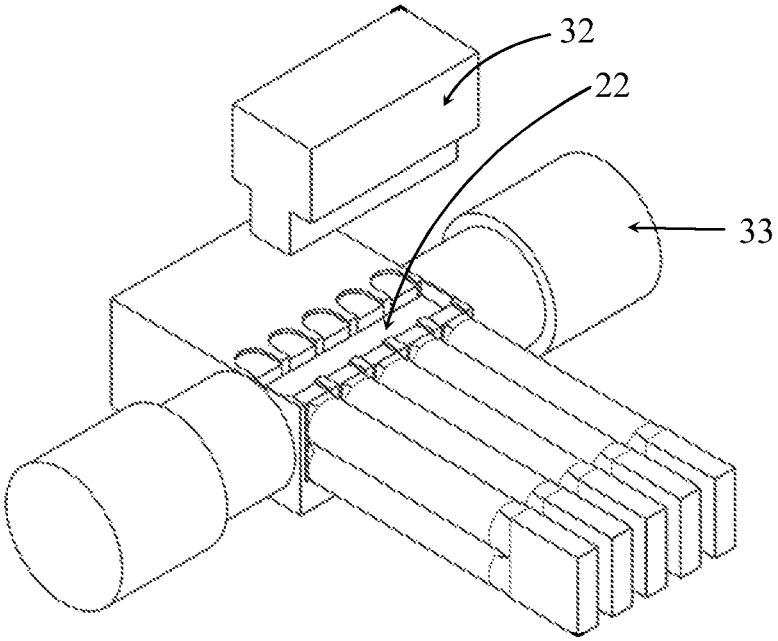

Advantageously, as illustrated for example in FIG. 18, at least part of the walls 21 between the slots 17 is clinched onto the associated end portion 2 inserted into the slot, so that it is covered at least partially and is substantially enclosed within the slot.

Preferably, the electrical component 100 comprises a plurality of slots 17, into each of which the end portion 2 of a corresponding flexible conductor 1 is inserted. As indicated above, at least part of the walls 21 between the slots 17 is clinched onto the corresponding end portion 2; in particular, as illustrated in FIG. 18, the entire junction zone 22, i.e. the slots 17 and intermediate zones between adjacent slots, is preferably clinched or fitted onto the ends 2 to form a compaction zone between the parts, which in practice creates a deeper bond and welding finish between the flexible conductors 1 and the electrode 10. In practice, the appearance and reduction in surface porosity achieved by this type of junction is much better than that achieved using traditional welding methods. Alternatively, as illustrated for example in FIG. 13, it is possible to clinch onto each end portion 2 only the corresponding slot 17 zone, without intervening on the intermediate areas between two adjacent slots 17.

Figure 10:
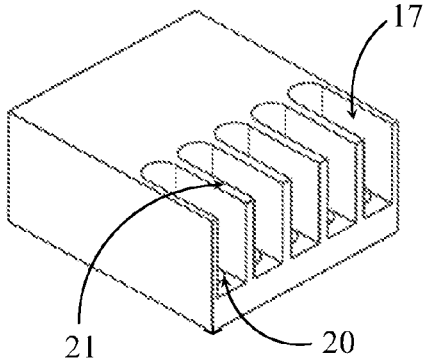
FIG. 10 is a perspective view partially illustrating a fifth form of manufacturing of an electrode used in the electrical component according to the invention.

In a first embodiment illustrated in FIGS. 1 and 10, the flexible conductor 1 has an end portion 2 that is inserted into an associated slot 17 and is joined to the electrode 10 so as to extend transversely from the rigid body of the latter with respect to the front face 15.

Figure 2:
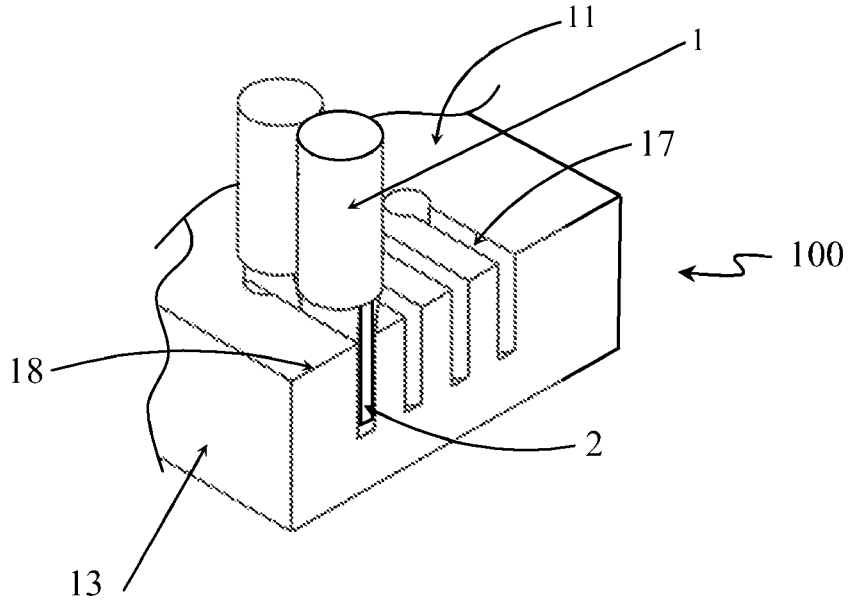
FIG. 2 is a perspective view partially illustrating a second embodiment of the electrical component according to the invention.

In a second embodiment illustrated in FIG. 2, the flexible conductor 1 has an end portion 2 that is inserted into an associated slot 17 and is joined to the electrode 10 so as to extend transversely from the rigid body of the latter with respect to the upper face 11.

This makes it possible to meet different construction needs for the component 100 inside an electrical switching device.

Preferably, the slots 17 comprise at least one wall shaped so as to have a relief zone that can hold part of the material of the end portion 2 when it is pushed into the slot 17. In addition, the slots 17 comprise at least one wall shaped so as to have an anti-tear zone for the same end portion 2.

Figure 3:
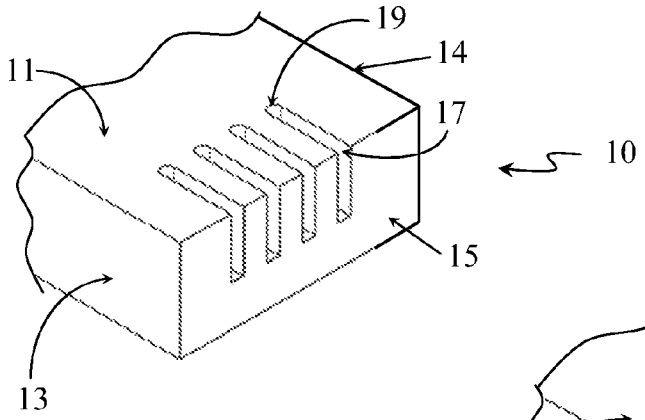
FIG. 3 is a perspective view partially illustrating a first form of manufacturing of an electrode used in the electrical component according to the invention.
Figure 4:
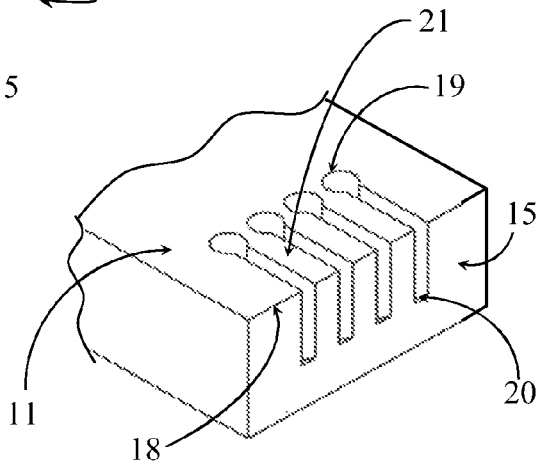
FIG. 4 is a perspective view partially illustrating a second form of manufacturing of an electrode used in the electrical component according to the invention.
Figure 5:
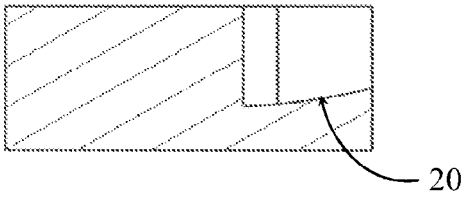
FIG. 5 is a cross-section side view of the electrode shown in FIG. 4.
Figure 7:
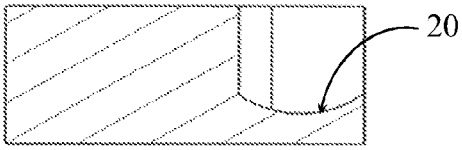
FIG. 7 is a cross-section side view of the electrode shown in FIG. 6.
Figure 6:
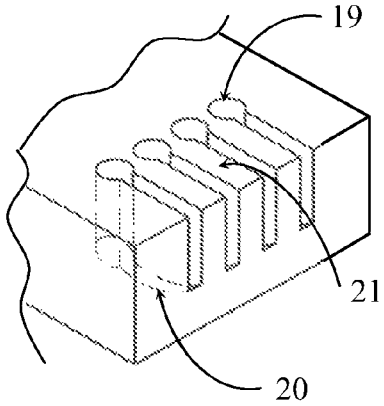
FIG. 6 is a perspective view partially illustrating a third form of manufacturing of an electrode used in the electrical component according to the invention.
Figure 9:
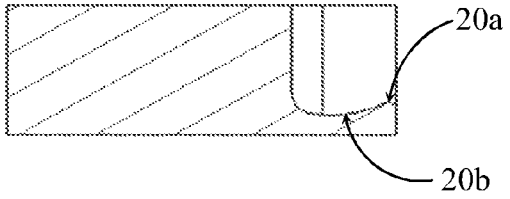
FIG. 9 is a cross-section side view of the electrode shown in FIG. 8.
Figure 8:
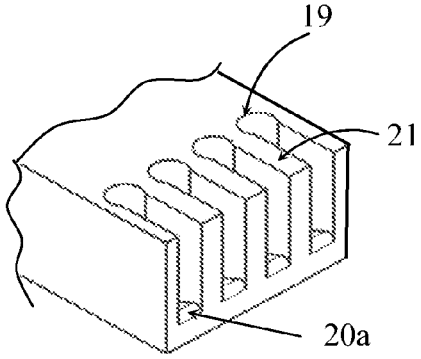
FIG. 8 is a perspective view partially illustrating a fourth form of manufacturing of an electrode used in the electrical component according to the invention.

In particular, in the embodiment illustrated in FIGS. 4, 6 and 8, the slots 17 comprise a rear wall 19 substantially in the shape of a C, thereby creating a bulge that constitutes a relief zone for the material of the end portion 2 when it is pushed into the slot 17; alternatively, as illustrated for example in FIGS. 3, 10 and 12, the rear wall 19 can have a substantially U-shape.

The slots 17 comprise a base wall 20 that constitutes an anti-tear zone and, seen in a side cross-section, may have a profile completely or partially straight, or otherwise shaped, particularly with a curved profile, or variously undulating or shaped profiles. For example, the base wall 20 may have a curved profile with a curvature more or less accentuated, or may follow a broken line based on specific applications and construction demands. For example, in the embodiment illustrated in FIGS. 6-9, the base wall 20 has a concave profile with the concavity facing the upper face 11 of the slot; in addition, as for example illustrated in FIGS. 8-9, at the front face 15, the base wall 20 may have a curved initial section 20*a*, with a curvature inverted with respect to the subsequent concave section 20*b*, so as to have a undulating, curved wave overall shape.

A similar anti-tear effect can also be achieved by treating the base wall 20 with ridges, indentations, or by modifying the conformation of the sides of the walls between the slots 17 so that they form flaring or expansion zones along their length towards the inside of the electrode.

In a preferred embodiment illustrated in FIGS. 10-11, the base wall 20 (seen in cross section) has an indented or square-wave undulating form created by means of at least one indent 23 sunk into the central part with respect to the ends of the base wall 20 itself; the edges of this indent may be rounded and/or bevelled as required.

In the example shown in FIG. 12, the sides of the walls 21 (seen from above) have a dovetail configuration with side walls that widen as one moves from the mouth of the front face into the electrode 10 body.

Clearly, the non-straight base wall 20 can also be used in the embodiment shown in FIG. 3, just a sit is also possible to use slots 17 with both the rear wall 19 and the base wall 20 perfectly straight, so that the slots 17 have a substantially L-shape side profile.

In any case, the overall form of the slots 17 and the relative walls 19 and 20 can derive from any of the combinations mentioned, and may also have forms other than those illustrated.

As indicated above, another aspect of the present invention relates to a method for manufacturing an electrical component 100 as described above that can be used in low-voltage switching devices. The method according to the invention includes the following steps:

a) preparing an electrode 10 comprised of a substantially rigid body on which there are one or more slots 17, as described above;

b) preparing at least one flexible conductor 1 with an end portion 2 that can be inserted into one of the slots 17;

c) inserting the end portion 2 into an associated slot 17;

d) joining the end portion 2 to the associated slot 17 by means of cold plastic deformation.

In particular, step d) includes a first step d.1) in which a first pressing action is applied to the end portion 2 of the flexible conductor 1 so as to press it into the slot 17 in which it is inserted and create the desired joint.

In addition, step d.1) is preferably followed by a step d.2) in which a second pressing action is applied to the joint zone between the end portion 2 and the associated slot 17, thus further sealing the electrode 1 and the flexible conductor 2, and clinching at least part of the slot 17 onto the corresponding end portion 2, which is closed inside the slot.

In this way, a substantially one-piece component 100 is created in which there is a sort of weld between the flexible conductor 1 and the electrode 10.

Preferably, the first and second pressing actions are performed substantially at the same pressure; this pressure is preferably between 0.5 and 1.5 GPa. In this way, along at least one part of the surfaces of the slots 17, there is a sufficiently diffuse penetration between the material of the electrode 10 and the flexible conductor 1, and therefore a large, stable degree of electrical and thermal conductivity.

For example, as illustrated in FIGS. 15-18, these operations can be performed using a suitable hydraulic press, for example a swan-neck press, in which step d.1) can be performed using a comb punch 31, and the subsequent step d.2), when performed, can be done using a rectangular punch 32. Where necessary, during the punching steps, the bodies of the electrodes 10 can be held in position, for example on a work bench, by means of clamps or similar devices 33 that can hold the sides of the electrodes 10.

Figure 14:
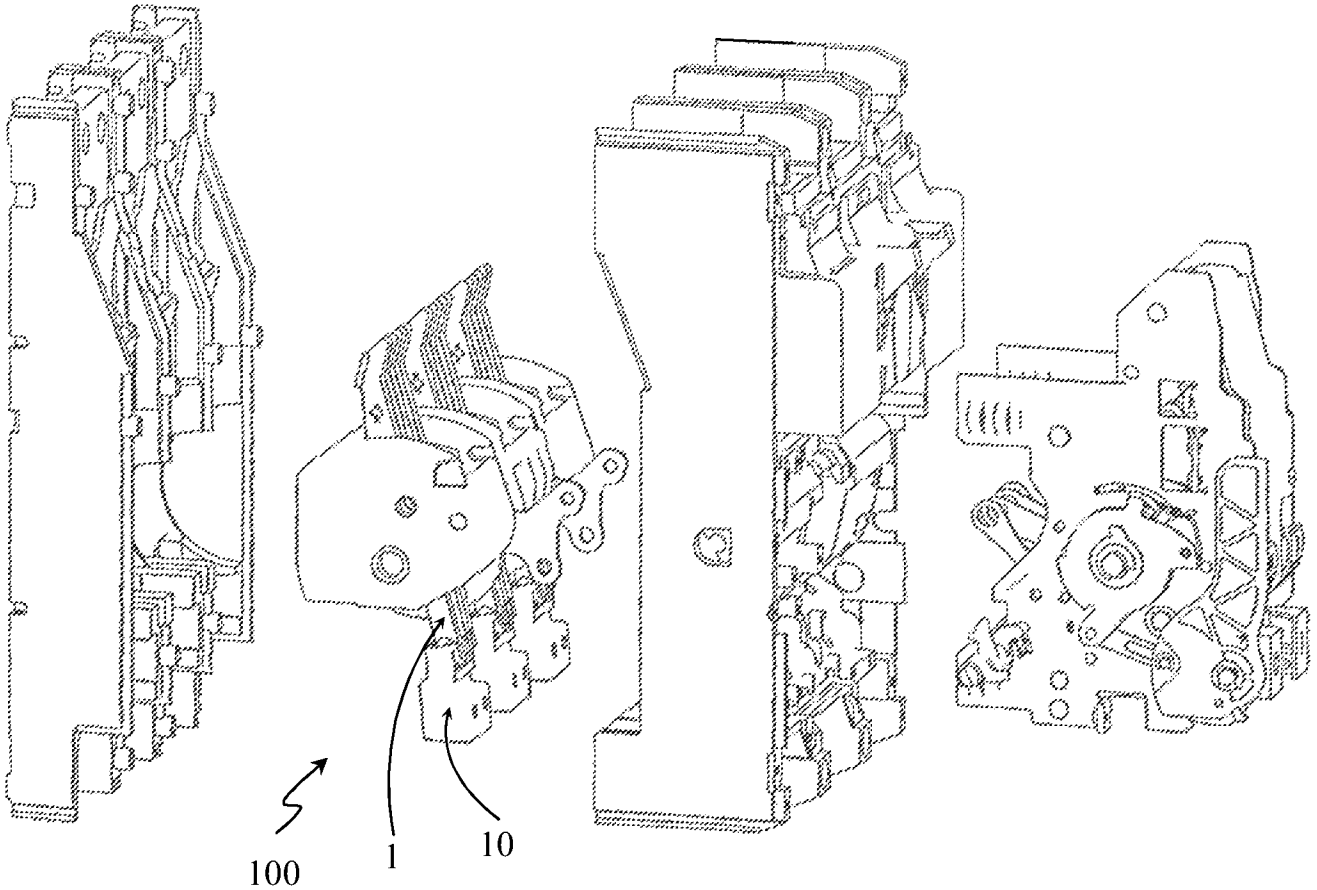
FIG. 14 is a perspective view illustrating a portion of automatic low-tension switch using an electrical component according to the invention.
Figure 15:
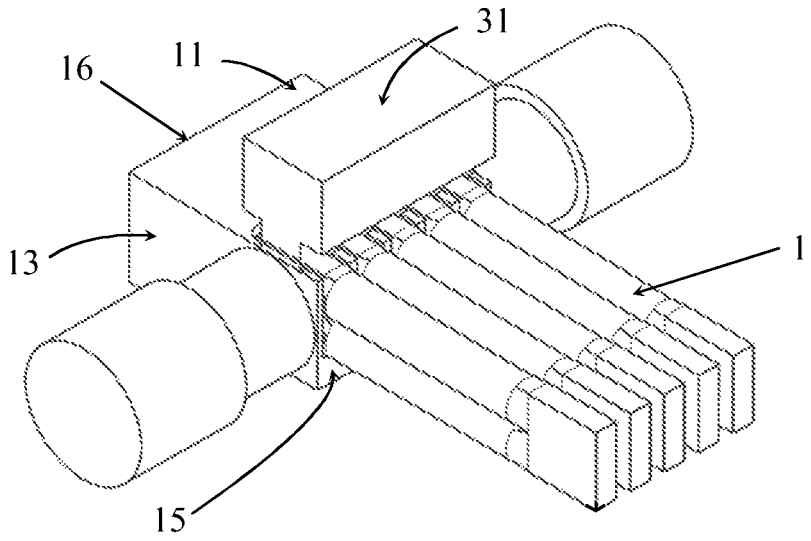
FIGS. 15-18 illustrate the various steps of the method for manufacturing an electrical component according to the invention.
Figure 16:
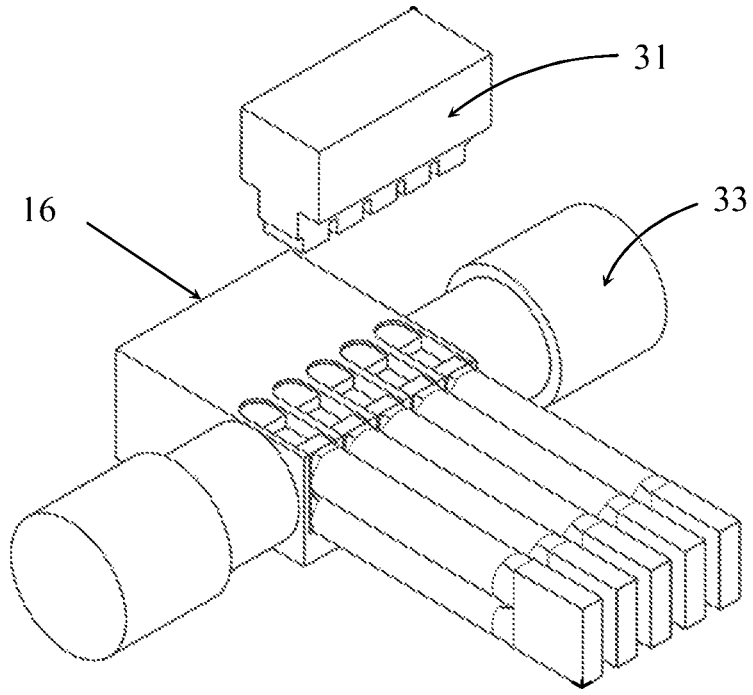
Figure 17:
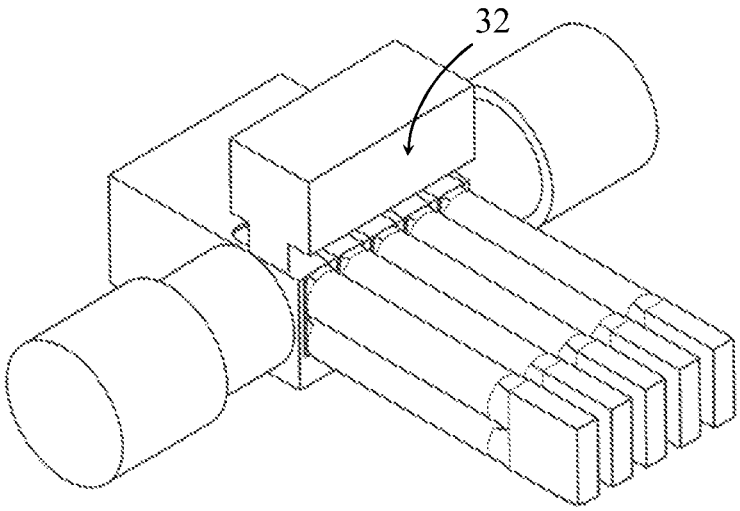

Every electrical component 100 according to the invention can be used in low-voltage electrical switching devices, such as for example automatic switches, isolating switches, contactors and similar equipment. In particular, the best technical and economical results are found in applications in equipment with high power outputs, such as for example open switches or Air Circuit Breakers (ACB). FIG. 14 illustrates schematically an automatic low-voltage switch comprising a component 100 according to the invention. Another aspect of the present invention, therefore, is constituted by an electrical switching device for low-voltage applications, characterised in that it comprises at least one electrical component 100 according to the invention and defined in the corresponding claims.

It has been seen how the electrical component according to the invention, and the method for its manufacture, fully achieve the object of the invention. In fact, the joint obtained between the electrode 10 and the flexible conductor 1 makes it possible to have a component 100 with excellent characteristics from the point of view both of mechanical and electrical properties. In particular, since the process of joining or welding the two parts is obtained substantially by cold fitting the flexible conductor 1 into the slot 17, problems of annealing of the flexible conductors typical of brazing processes and to a lesser extent of laser processes, are avoided, and the filling factor in the junction zone is definitely superior to that achieved using laser welding techniques. For example, the absence of annealing phenomena allows the flexible conductors to work substantially within the elastic range, reducing gradual breakage due to plastic deformation; in addition, the mechanical strength of the joint is increased, and therefore greater energy is required to cause the forced detachment of the flexible conductor from the connection.

The method according to the invention can also be inserted in automated production cycles, thus making it possible to produce components 100 efficiently and relatively economically. In particular, the absence of annealing of the flexible conductor reduces friction and passive resistance to movement, thereby improving the dynamic behaviour of the moving contact in switching devices. Switches comprising the component 100 have greater electrical efficiency and fewer losses due to the Joule effect, resulting in an increased working life; in addition, the reduction in unwanted heating of the switch limits the process of decay of all thermally-sensitive components of the switch, particularly plastic materials and electronic parts. Lastly, the weld cycle time for cold mechanical deformation (generally referred to also as clinching or calking) is lower than the time required by traditional welding.

The component 100 and the relative method for its manufacture thus described are subject to several modifications and variants, all of which fall within the context of the inventive concept as defined in the corresponding claims; for example, the body of the electrode 10, the flexible conductor 1 with the relative end portion 2, and the slots 17, could have a different shape and/or position.

In practice, the materials used, provided they are compatible with the specific use, and their dimensions, can vary according to needs and the state of the art.

The invention claimed is:

1. Electrical component for low-voltage switching devices, wherein it comprises an electrode comprised of a substantially rigid body with one or more slots and at least one flexible conductor with an end portion inserted into and joined to an associated slot by means of cold plastic deformation obtained by applying a first pressing action to said end portion of the flexible conductor inserted into said associated slot and by applying a second pressing action to the joint zone between said end portion and the associated slot.

2. Electrical component according to claim 1, wherein at least part of the walls of said associated slot is clinched onto said end portion inserted into it, so that it is covered at least partially.

3. Electrical component according to claim 1, wherein said rigid body has at least one upper face, a lower face, two side faces, and a front face that is transversal to said upper and lower faces and said side faces, said one or more slots being positioned and open to correspond with at least one of said front or upper faces.

4. Electrical component according to claim 3, wherein said one or more slots are positioned at the common edge between said upper face and front face, and are open both on the upper face and the front face.

5. Electrical component according to claim 1, wherein said flexible conductor has an end portion inserted into a slot and joined to the electrode so as to extend transversely from the rigid body with respect to said front face or said upper face.

6. Electrical component according to claim 1, wherein said one or more slots comprise at least one wall shaped so as to have a relief zone that can hold part of said end portion when it is pushed into the associated slot.

7. Electrical component according to claim 1, wherein said one or more slots comprise at least one wall shaped so as to have an anti-tear zone for said end portion.

8. Electrical component according to claim 1, wherein said one or more slots comprise a rear wall substantially in the shape of a U or C.

9. Electrical component according to claim 7, wherein said one or more slots comprise a base wall with at least one section with an undulating profile.

10. Electrical component according to claim 9, wherein said base wall has at least one indent sunk into the central part with respect to the two ends of the base wall itself.

11. Electrical component according to claim 9, wherein said one or more slots comprise a base wall with at least one section with a curved profile.

12. Electrical component according to claim 11, wherein said base wall has a curved shape with a concave section with the concavity facing the upper face of the rigid body.

13. Electrical component according to claim 12, wherein said base wall has at least a first concave section with the concavity facing the upper face of the rigid body, and a second section with a curvature inverted with respect to said first section.

14. Electrical switching component for low-voltage applications, wherein it comprises at least one electrical component according to claim 1.

15. Method for the manufacture of an electrical component for low-voltage switching devices, wherein it includes the following steps:

a) preparing an electrode comprised of a substantially rigid body on which there are one or more slots;

b) preparing at least one flexible conductor with an end portion that can be inserted into one of said slots;

c) inserting said end portion into an associated slot;

d) joining said end portion to the associated slot by means of cold plastic deformation;

wherein the joining comprises:

first pressing the end portion of the flexible conductor inserted into the associated slot; and second pressing, after the first pressing, a joint zone between the end portion and the associated slot.

16. Method according to claim 15, wherein said first and second pressing are performed substantially at the same pressure.

17. Electrical component according to claim 2, wherein said flexible conductor has an end portion inserted into a slot and joined to the electrode so as to extend transversely from the rigid body with respect to said front face or said upper face.

18. Electrical component according to claim 3, wherein said flexible conductor has an end portion inserted into a slot and joined to the electrode so as to extend transversely from the rigid body with respect to said front face or said upper face.

* * * * *